US005692667A

United States Patent [19]

Chi

[11] Patent Number: 5,692,667

[45] Date of Patent: Dec. 2, 1997

[54] DOCUMENT POSITIONING MEMBER FOR A STAPLER

[76] Inventor: William H. N. Chi, 8th Fl.-2, No. 92, Chingcheng Rd., West Dist., Taichung, Taiwan

[21] Appl. No.: 768,182

[22] Filed: Dec. 17, 1996

[51] Int. Cl.[6] ..... B25C 1/00

[52] U.S. Cl. ..... 227/151; 227/134

[58] Field of Search ..... 237/120, 5, 6, 237/7, 133, 151, 156

[56] References Cited

U.S. PATENT DOCUMENTS

| | | | |
|---|---|---|---|
| 1,480,167 | 1/1924 | Kridler et al. | 227/151 |
| 2,073,958 | 3/1937 | Crosby | 227/151 |
| 2,897,500 | 8/1959 | Lang | 227/151 |
| 3,523,634 | 8/1970 | Power et al. | 227/151 |
| 5,267,682 | 12/1993 | Okouchi | 227/151 |
| 5,628,445 | 5/1997 | Braddock et al. | 227/151 |

*Primary Examiner*—Scott A. Smith
*Attorney, Agent, or Firm*—Foley & Lardner

[57] ABSTRACT

A member for a stapler includes a transverse bar having two stops extending upwardly from two ends thereof, an extending portion extending downwardly from an under side of the transverse bar so as to be inserted through a slot of a base of the stapler, two bow-shaped elements extending from the extending portion and two protrusions extending downwardly from the under side of the transverse bar. The two bow-shaped elements are urgedly engaged to an under side of the base of the stapler.

3 Claims, 4 Drawing Sheets

DOCUMENT POSITIONING MEMBER FOR A STAPLER

BACKGROUND OF THE INVENTION

1. Field of the Invention

The present invention relates to a positioning member and, more particularly, to an improved document positioning member for a stapler wherein the positioning member is made to be a one-piece member so as to be easily disposed to a base of the stapler.

2. Brief Description of the Prior Art

A stapler as shown in FIG. 1 is used to staple sheets of paper of a certain thickness. The stapler generally includes a base 50 having a slot 51 defined longitudinally therein, a handle 55 pivotally connected to one end of the base 50, a staple magazine 52 disposed to an under side of the handle 55 wherein staplers (not shown) are received in the staple magazine 52, an end plate 56 disposed to the staple magazine 52 so as to define an exit 53 in an under side between the staple magazine 52 and the end plate 56 and, an anvil portion 54 fixedly disposed to an upper surface of the base 50 such that when the handle 55 is pushed downwardly, sheets of paper (not shown) put on the upper surface of the base 50 between the staple magazine 52 and the base 50 are stapled together by staple(s) via an exit 53. In order to accurately put the sheets of paper on the base 50 so that the staples are stapled on positions having a desired distance away from edges of the sheets of paper, a document positioning member 60 is used.

The document positioning member 60 includes an transverse bar 601 which has two stops 602 respectively extending upwardly from two ends thereof and an inserting rod 603 extending downwardly from a middle point of the transverse bar 601 so as to be inserted through the slot 51 and be positioned by threading a bolt 63 to the inserting rod 603 cooperating with a washer 62 and a spring 61. The document positioning member 60 is movable along the slot 51 to set a distance between the document positioning member 60 and the anvil portion 54. However, such an assembly includes too many elements to dispose the document positioning member 60 to the base 50.

Another document positioning member 80 as shown in FIG. 2 is developed to improve the document positioning member 60 shown in FIG. 1. The document positioning member 80 has two stops 801 extending upwardly therefrom and two hooks 81 extending downwardly therefrom so as to be inserted through the slot 51' of the base 50'. A flexible member 82 is movably disposed to an under side of the base 50' and the hooks 81 are engaged to the flexible member 82 such that the document positioning member 80 is more easily disposed to the base 50' than the one shown in FIG. 1.

The present invention intends to provide an improved document positioning member which has two bow-shaped elements formed to an under side thereof and is directly inserted through the slot of the base so as to mitigate and/or obviate the above-mentioned problems.

SUMMARY OF THE INVENTION

The present invention provides a document positioning member for a stapler and includes a transverse bar having two stops respectively extending upwardly from two ends thereof, an extending portion extending from an under side of the transverse bar, two bow-shaped elements respectively from the extending portion and two protrusions extending downwardly from the under side of the transverse bar.

It is an object of the present invention to provide a document positioning member which is easily disposed to a stapler.

It is another object of the present invention to provide a document positioning member which is made to be a one-piece element.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
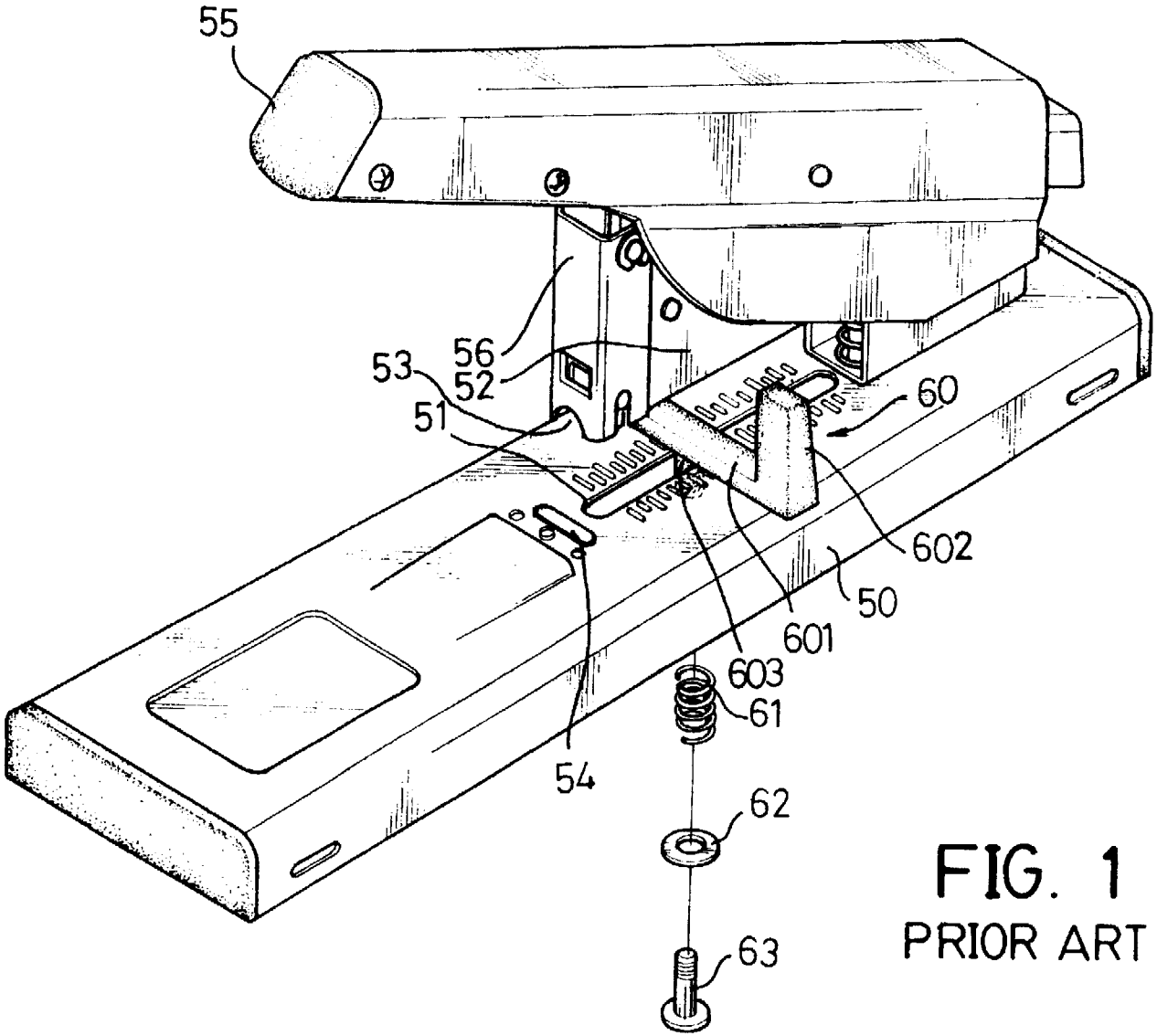
FIG. 1 PRIOR ART
FIG. 1 is a perspective view of a stapler having a conventional document positioning member disposed thereto.
Figure 2:
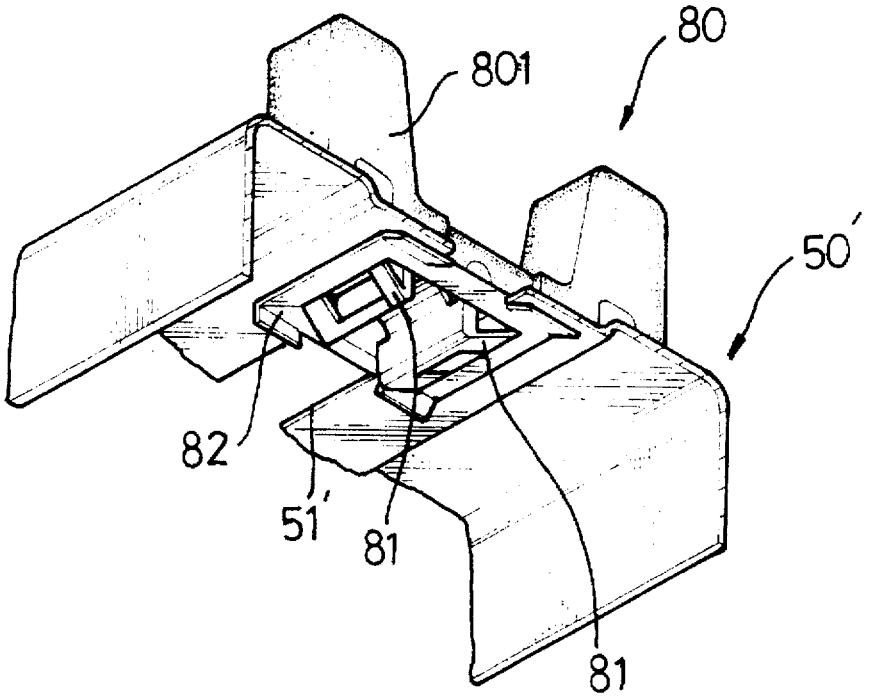
FIG. 2 PRIOR ART
FIG. 2 is a perspective view of another conventional document positioning member disposed to a base (only a part of the base is shown)
Figure 5:
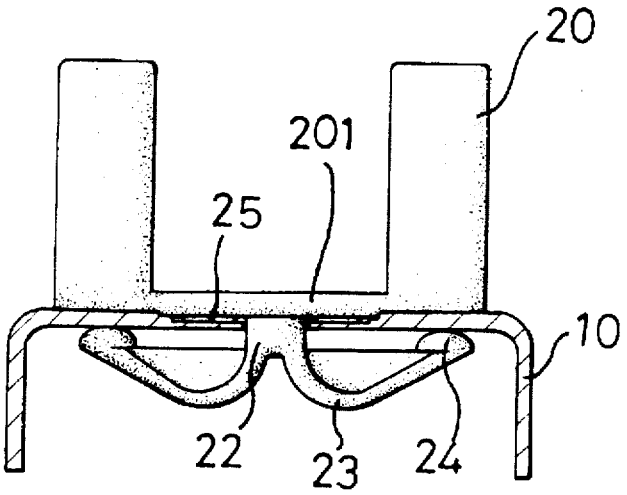
FIG. 5 is a side elevational view, partly in section, of the document positioning member in accordance with the present invention disposed to the base.
Figure 3:
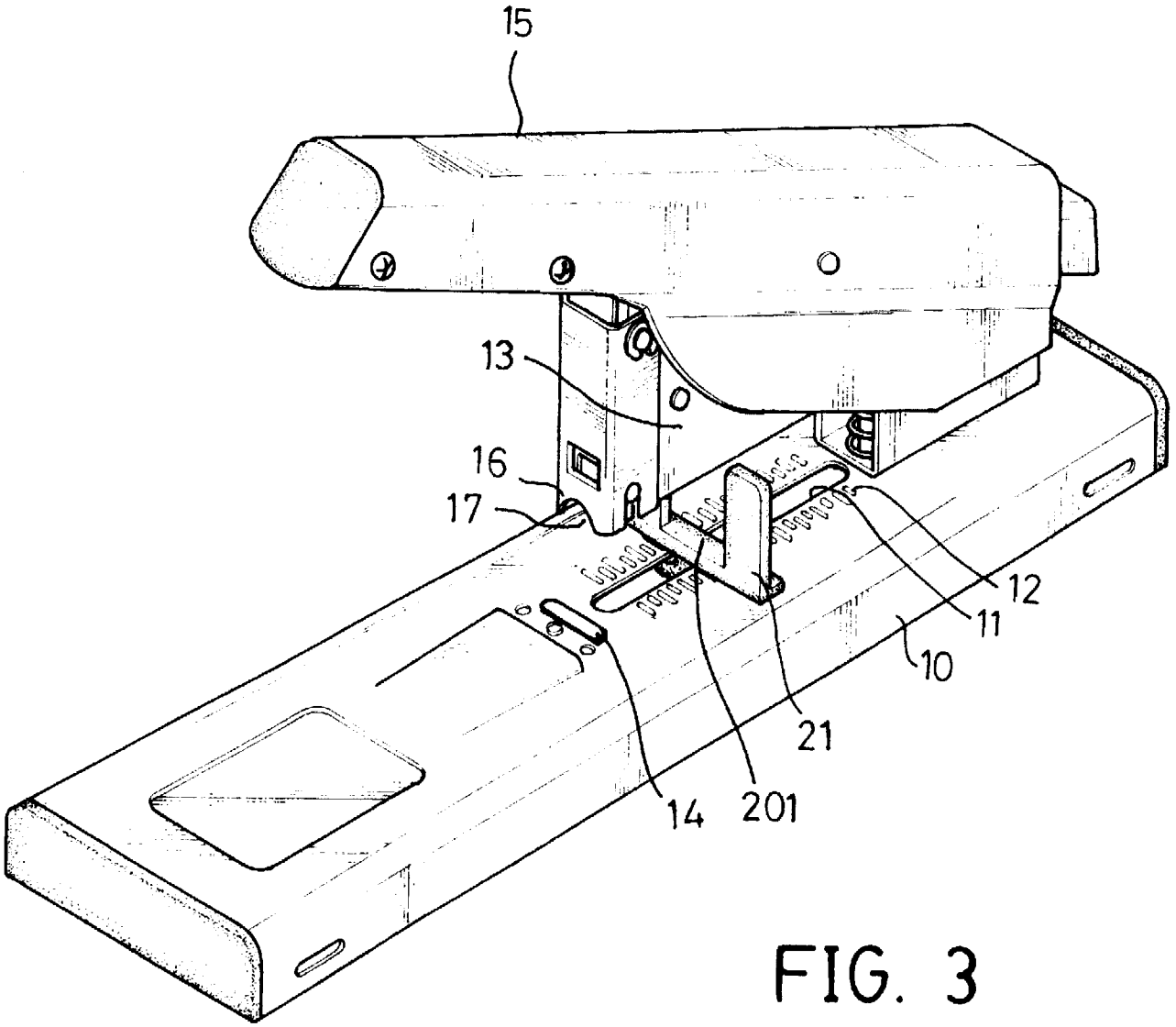
FIG. 3 is a perspective view of a stapler having a document positioning member in accordance with the present invention disposed thereto.
Figure 4:
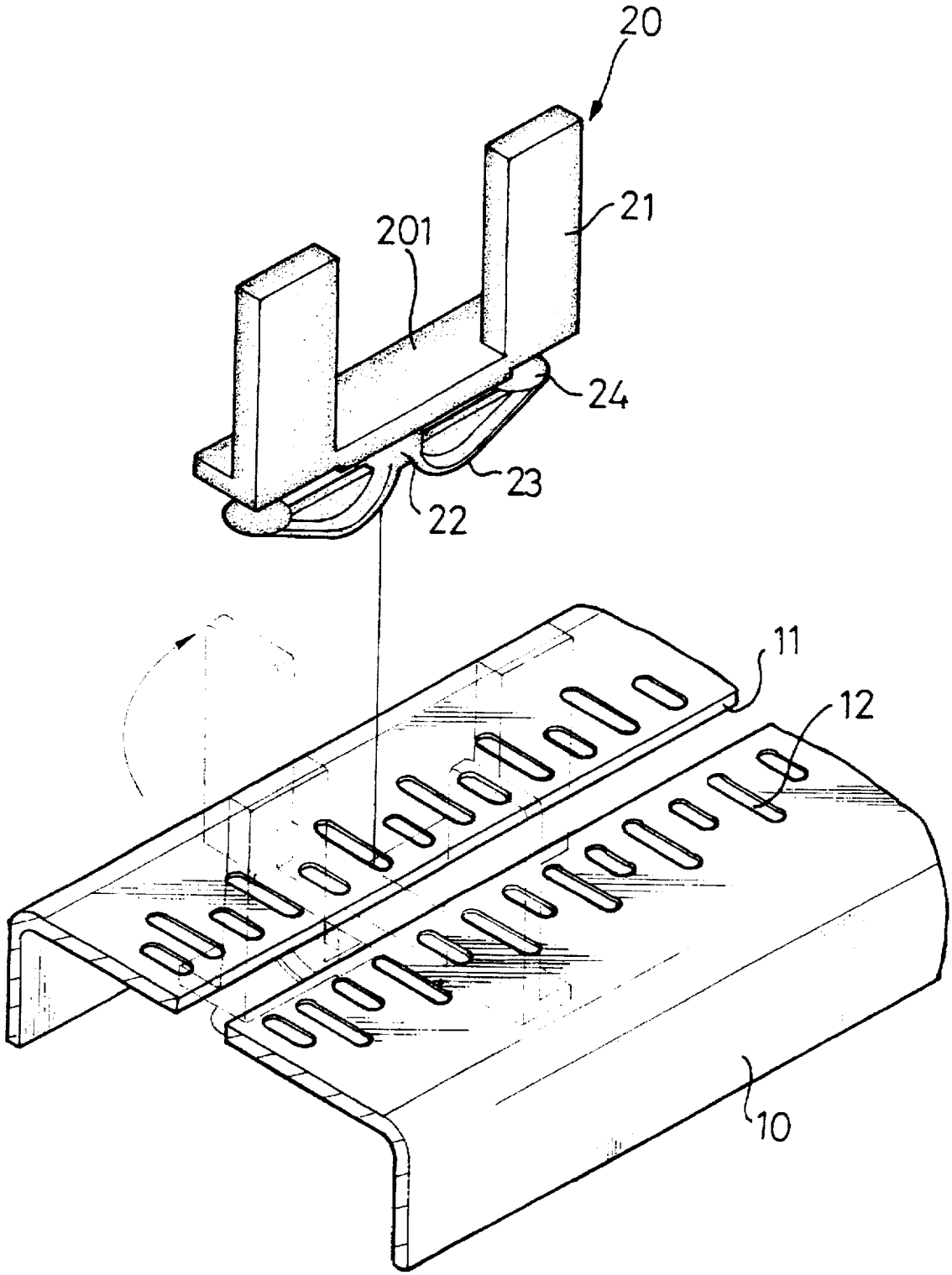
FIG. 4 is an exploded view of the document positioning member in accordance with the present invention and a section of a base.

Referring to FIGS. 3 through 5, a stapler includes a base 10 having a slot 11 defined longitudinally in an upper surface thereof and a plurality of recesses 12 defined beside the slot 11. A handle 15 is pivotally connected to one end of the base 10 and a staple magazine 13 is disposed to an under side of the handle 15 wherein staplers (not shown) are received in the staple magazine 13. An end plate 16 is disposed to a front end of the staple magazine 13 so as to define an exit 17 in an under side between the staple magazine 13 and the end plate 16. An anvil portion 14 is fixedly disposed to the upper surface of the base 10.

A document positioning member 20 in accordance with the present invention generally includes a transverse bar 201 having two stops 21 respectively extending upwardly from two ends thereof. An extending portion 22 extends downwardly from an under side of the transverse bar 201 and two urging elements such as two bow-shaped elements 23 extend from the extending portion 22 wherein the two bow-shaped elements 23 each have an enlarged head 24 formed to a free end thereof. The transverse bar 201 has two protrusions 25 (see FIG. 5) extending downwardly from the under side thereof and located two opposites sides of the extending portion 22.

When assembling the document positioning member 20 to the base 10, the two bow-shaped elements 23 are inserted through the slot 11 and the document positioning member 20 is then rotated 90 degrees to let the upper surface of the base 10 be clamped between the transverse bar 201 and the two bow-shaped elements 23 with the enlarged heads 24 contact against an under side of the base 10. The protrusions 25 are inserted into the recesses 12. Therefore, the document positioning member 20 is moved along the slot 11 and the protrusions 25 can be selectably engaged with the recesses 12 by deformations of the bow-shaped elements 23. The enlarged heads 24 of the bow-shaped elements 23 thus slide on the under side of the base 10.

Accordingly, the document positioning member 20 in accordance with the present invention includes a simple structure and is easily disposed to the base 10 of a stapler.

Although the invention has been explained in relation to its preferred embodiment, it is to be understood that many other possible modifications and variations can be made without departing from the spirit and scope of the invention as hereinafter claimed.

What is claimed is:

1. A document positioning member for a stapler, comprising a transverse bar having two stops respectively extending upwardly from two ends thereof, an extending portion extending from an under side of said transverse bar, two urging elements extending from said extending portion and two protrusions extending downwardly from said under side of the transverse bar.

2. The document positioning member as claimed in claim 1 wherein said extending portion is located between said two protrusions.

3. The document positioning member as claimed in claim 1 wherein each of said two urging elements is a bow-shaped element which has an enlarged head formed to a free end thereof.

* * * * *